US005281857A

United States Patent [19]

Keese

[11] Patent Number: 5,281,857

[45] Date of Patent: Jan. 25, 1994

[54] SELF-CHECKING INTERLOCK CONTROL SYSTEM

[75] Inventor: Brendan T. Keese, Whitefish Bay, Wis.

[73] Assignee: Square D Company, Palatine, Ill.

[21] Appl. No.: 880,273

[22] Filed: May 8, 1992

[51] Int. Cl.[5] ..... H01H 47/22

[52] U.S. Cl. ..... 307/115; 361/160; 361/192; 361/189; 307/328

[58] Field of Search ..... 361/192, 193, 189, 160; 307/115, 328

[56] References Cited

U.S. PATENT DOCUMENTS

Re. 28,822 5/1976 Fritts ..... 317/40
4,245,271 1/1981 Gwin ..... 361/189
4,392,176 7/1983 Kneip et al. ..... 361/160
5,077,631 12/1991 Cleary ..... 361/192

*Primary Examiner*—A. D. Pellinen
*Assistant Examiner*—Aditya Krishnan
*Attorney, Agent, or Firm*—Michael J. Femal; Richard J. Graefe; Larry I. Golden

[57] ABSTRACT

A self checking interlock modular control system allows for an unlimited number of interlocks to be connected into a single interlock control circuit. The interlock control system provides a method of determining if the components within each interlock module of the control system function correctly when the individual interlocks are opened and closed. The interlock control system has redundant components to provide a circuit path to insure that the interlock control system will open circuit the output if one of the components fails.

12 Claims, 4 Drawing Sheets

SELF-CHECKING INTERLOCK CONTROL SYSTEM

TECHNICAL FIELD

Applicants invention relates generally to electrical control mechanisms and more particularly to a method of coupling a series of interlock switches used to control the operation of safety circuits and other types of interlock control systems. The system allows multiple interlocks to be used to control a single function.

BACKGROUND ART

Interlock systems that control the operation of various types of machinery are well known. In most instances, these interlock systems are required to be hardwired, electromechanical, and self-checking. The interlocks typically consist of a number of normally closed contacts connected in series to energize a control relay. These interlocks include, but are not limited to emergency stop push buttons, limit switches, open door indicators, palm switches, and so on. As long as the interlocks are closed, the relay remains energized and the machine can operate. Opening any one of the interlocks causes the relay to deenergize and the machine is shut down. These normally closed contacts will always have a finite voltage drop across them. With more complex machinery, the number of contacts wired in series becomes very large. The ohmic losses across these contacts is such that the sum of these voltage drops may prevent the control relay from energizing. As a result, other systems must be utilized. One method to overcome this drawback is to divide the interlocks into smaller groups of series interlock connections and then use each one of these groups to energize a separate interposing relay. The contacts from these separate interposing relays are then connected in another series connection to energize the final control relay that controls the operation of the machine.

Whereas this method may provide sufficient control in some simple applications, other interlock systems require redundant controls and the ability to provide a means for self-checking the contacts to determine if they open and close properly. The present invention provides a self checking control system that addresses these and other problems.

SUMMARY OF THE INVENTION

Accordingly, an object of the present invention is to provide a self checking interlock modular control system that allows for an unlimited number of interlocks to be connected into a single interlock control circuit. The interlock control system utilizes electromechanical relays with hard contacts.

Another object of the invention is to provide a method of determining if the contacts within each module of the control system function correctly when the individual relays are energized and deenergizing.

Still another object of the invention is to provide a redundant circuit path to verify the integrity of the components in each module of the interlock control system.

The above objects are achieved and the disadvantages of the prior art are overcome in part through the use of a self-checking modular control circuit. As with the interposing relay approach, the interlocks are divided into smaller groups of series connected interlocks. Each one of these groups becomes an input to a separate self-checking modular control circuit. The output contacts from these separate modular control circuits are then connected in another series connection of groups of three modules to input into another separate self-checking modular control circuit. This tree process is repeated until there are three or less module outputs connected in series. These outputs are then used to energize the final control relay that controls the operation of the machine.

Other features and advantages of the invention will become apparent from the following description and accompanying drawings, in which is shown a preferred embodiment of the invention.

DETAILED DESCRIPTION

Although this invention is susceptible to embodiments of many different forms, a preferred embodiment will be described and illustrated in detail herein. The present disclosure exemplifies the principles of the invention and is not to be considered a limit to the broader aspects of the invention to the particular embodiment as described.

Figure 1:
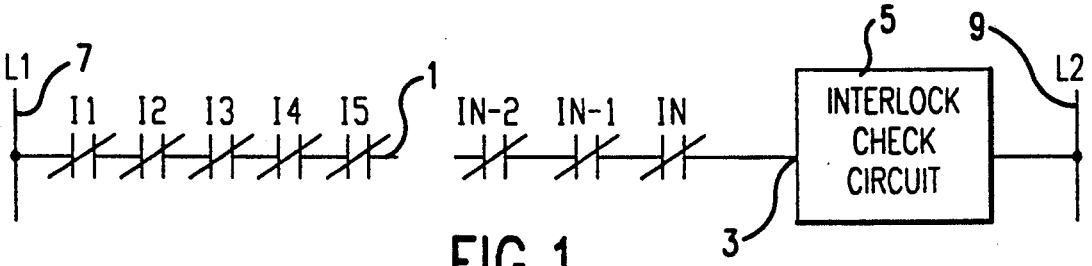
FIG.1 PRIOR ART
FIG. 1 is a block diagram of a typical control system using conventional series connected interlocks to control a single interlock check circuit representative of the prior art.

Referring to FIG. 1 of the drawings, a typical control system using conventional series connected interlocks to control a single interlock check circuit is illustrated. Interlocks 1, I1 through IN are connected in series as an input 3 to interlock check circuit 5. The interlock check circuit 5 can be used to control the operation of any type of machine. As previously mentioned, these interlocks 1 include normally closed emergency stop push button contacts, door interlocks, and position indication limit switches. Other types of interlocks are also possible. As long as all the interlocks 1 are in their normally closed position, the control voltage L1 is available at input 4 and the interlock check circuit 5 would allow the machine that it is controlling to function. If any of the interlocks 1 opens, the circuit between L1 and L2 is broken and the interlock check circuit 5 would stop the operation of the machine.

Figure 2:
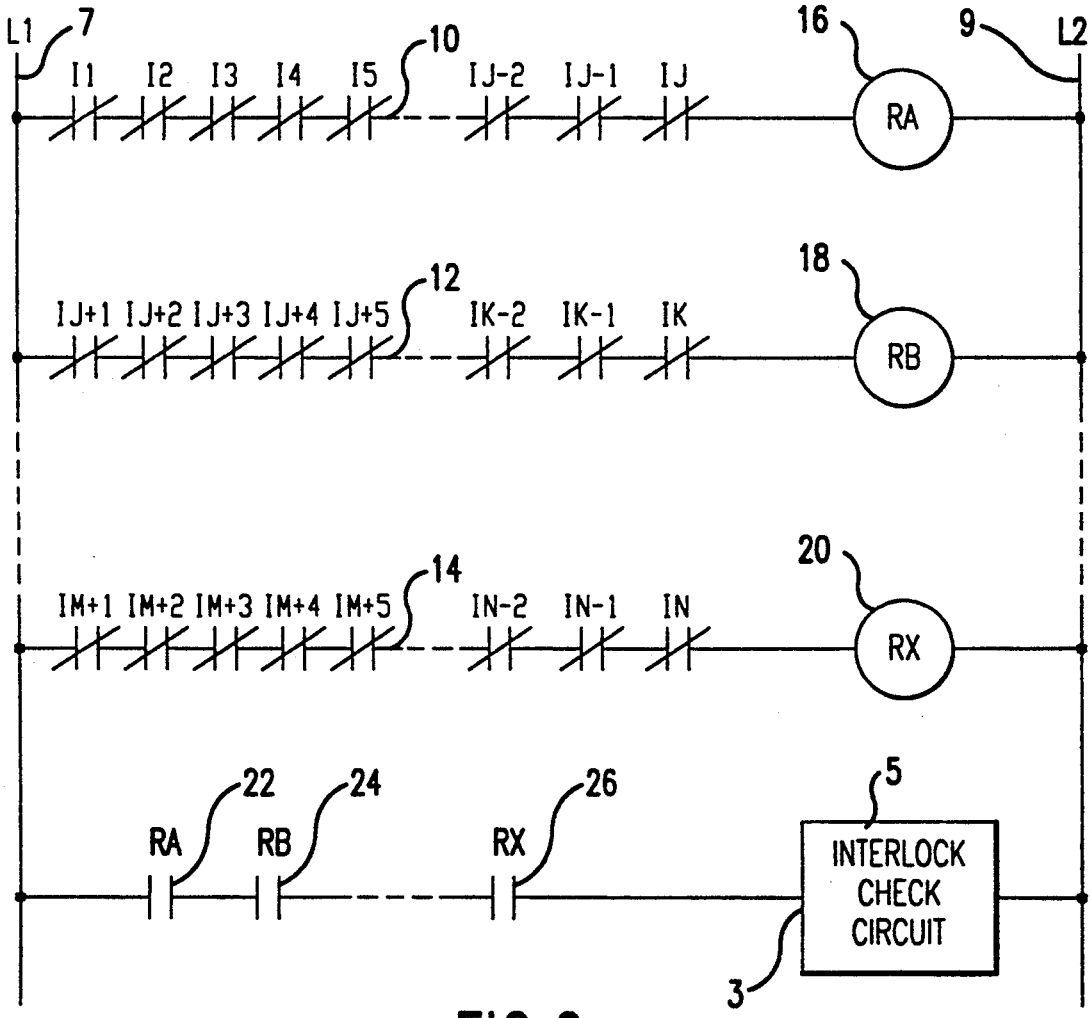
FIG.2 PRIOR ART
FIG. 2 is a block diagram of a typical control system using groups of conventional series connected interlocks to control separate interposing relays that control single interlock check circuit representative of the prior art.

As the number of interlocks increase, the reliability of the circuit decreases. The contacts of each interlock 1 exhibit a certain amount of resistance, resulting in voltage drops. If too many are connected in series, there may not be sufficient voltage present at the input 3 and the interlock check circuit 5 may not energize when it should. FIG. 2 illustrates the same control system as FIG. 1 configured in a manner to eliminate that potential problem by utilizing a set of interposing relays. The series of N interlocks 1, numbered I1 through IN is divided into several groups of interlocks 10, 12, . . . , 14. The grouping could be according to functionality or location. Each group 10, 12, . . . , 14 has its own interposing relay 16, 18, . . . , 20, respectively. Thus, relay 16, RA, is energized when all of its series connected interlocks 10, I1 through IJ are closed and relay 20, RX, is energized when all of its series connected interlocks 14, IM+1 through IN are closed. The normally open contacts 22, 24, . . . , 26 of the respective relays RA, Rb, . . . , RX are therefore closed when the interlocks in their respective groups are closed. These series connected contacts 22, 24, . . . , 26 become the input 3 of the interlock check circuit 5. Opening any of the interlocks I1 through IN will cause the respective relay RA, Rb, . . . , or RX to deenergize, opening its respective contact and deenergizing the interlock check circuit 5. Whereas this arrangement reduces the number of interlocks connected in series for any one string, there are no means for checking the operation of the interposing relays 16, 18, . . . , 20 themselves to verify that their contacts open and close and are not welded.

Figure 3:
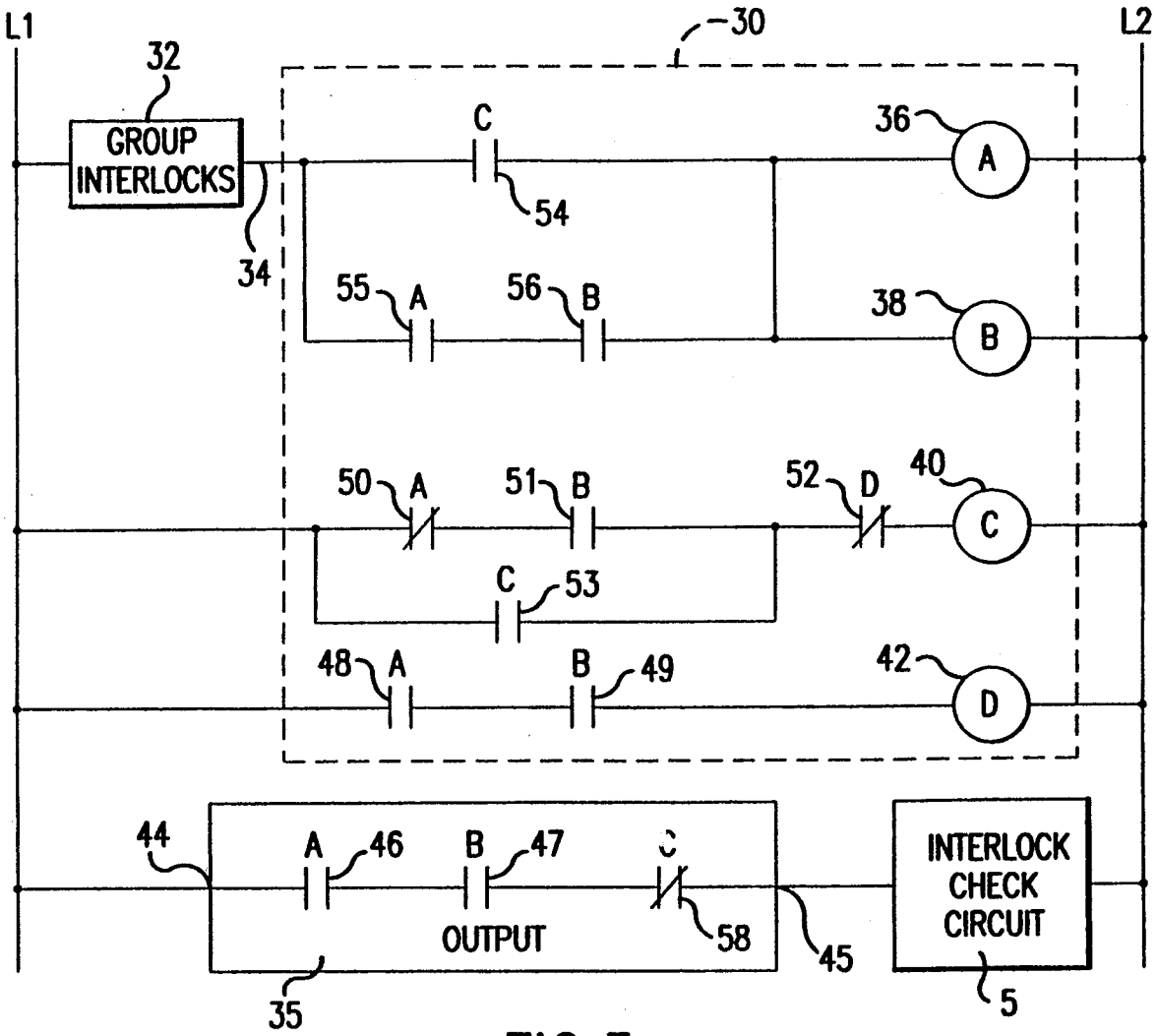
FIG. 3 is a block diagram of the self-checking modular control circuit constructed according to the preferred embodiment.

Referring now to FIG. 3, a self-checking modular control circuit 30 constructed according to the preferred embodiment is disclosed. A series connected group of normally closed interlocks 32 becomes the input 34 of the modular circuit 30. Four relays become the basis for the control. Relay A and relay B are redundant for self checking purposes and give a positive indication that the series string of interlocks 32 are closed. Relay C functions as a check relay to verify that relay A and relay B deenergize when one of the interlocks 32 opens. Relay D prevents race conditions between relays A, B, and C. Output 35 provides the input to the interlock check circuit 5 that controls the operation of the machine under control.

The operation of the modular circuit 30 is as follows. At initialization and with any of the group interlocks 32 open, L1 is not present at the input 34 and consequently, not present at coils 36, 38 of relays A and B. With relays A and B deenergized, output 35 between 44 and 45 is open due to normally open (NO) contacts 46 and 47 of relays A and B being open. L1 is therefore removed from the input to the interlock check circuit 5, preventing operation of the machine under control. NO contacts 48 and 49 of relays A and B prevent L1 from energizing the coil 42 of relay D. With relays A, B, and D deenergized, L1 is present at coil 40 through normally closed (NC) contacts 50, 51, and 52 to energize Relay C. NO contact 53 provides a bypass for contacts 50 and 51, the function of which will be described below. With relay C energized, NO contact 54 closes and the circuit is initialized, waiting for all of the group interlocks 32 to be closed.

When the group interlocks 32 are all closed, L1 is present at parallel coils 36 and 38, energizing relays A and B through NO contact 54. NO contacts 55 and 56 provide a holding path for relays A and B. NC contacts 50 and 51 open, but relay C remains energized through NO contact 53 of relay C and NC contact 52 of relay D. This allows sufficient time for contacts 55 and 56 to latch relays A and B before NO contact 54 of relay C opens, preventing a race condition between relays A, B, and C from occurring a holding path for relays A and B. NO contacts 48 and 49 of relays A and B also close, allowing L1 to energize the coil 42 of relay D. With relay D energized, NC contact 52 removes L1 from coil 40, deenergizing relay C. NC contact 58 closes and the output 35 between 44 and 45 is closed due to NO contacts 46 and 47 of relays A and B also being closed. L1 is therefore available to the interlock check circuit 5, allowing operation of the machine under control.

If one of the group interlocks 32 opens, L1 is removed from coils 36 and 38 through NO contacts 55 and 56 and relays A and B deenergize. This causes NO contacts 46 and 47 of relays A and B to open, removing L1 from interlock check circuit 5, causing the machine under control to stop operating. NO contacts 48 and 49 of relays A and B also open, deenergizing the coil 42 of relay D. With relay D deenergized, NC contact 52 closes and along with the closing of NC contacts 50 and 51, relay C energizes. This provides an orderly reset of the circuit 30 to allow it to monitor the group interlocks 32 for reclosure of the open interlock.

The modular circuit 30 is self checking. A failure of any of the relays A, B, C, or D will prevent output 35 from providing L1 to the interlock check circuit 5 and the machine under control will not operate.

If relay A fails to energize, NO contact 46 will not close and output 35 is open. If relay A fails to deenergize when a group interlock 32 opens, NC contact 50 will not close, preventing coil 40 from energizing relay C. If relay C cannot energize, coil 38 cannot energize relay B through contact 54 when the group interlock 32 recloses. This will prevent NO contact 47 of relay B from closing and output 35 remains open. The same conditions exist if redundant relay B fails in either fashion. If relay B fails to energize, NO contact 47 will not close and output 35 is open. If relay U-fails to deenergize when a group interlock 32 opens, NC contact 51 will not close, preventing coil 40 from energizing relay C. If relay C cannot energize, coil 36 cannot energize relay A through contact 54 when the group interlock 32 recloses. This will prevent NO contact 45 of relay A from closing and output 35 remains open.

If relay C fails to energize, NO contact 54 will not close and relays A and B can not energize. Output 35 is open. If relay C fails to deenergize, NC contact 58 will not close, and output 35 remains open.

Lastly, if relay D fails to energize, NC contact 52 will not open and relay C will not deenergize. NC contact 58 of relay C will not close, and output 35 remains open. If relay D fails to deenergize, NC contact 52 will prevent relay C from energizing. If relay C cannot energize, coils 36 and 38 cannot energize relays A and B through contact 54 when the group interlock 32 recloses. This will prevent NO contacts 45 and 47 of relays A and B from closing and output 35 remains open.

Figure 4:
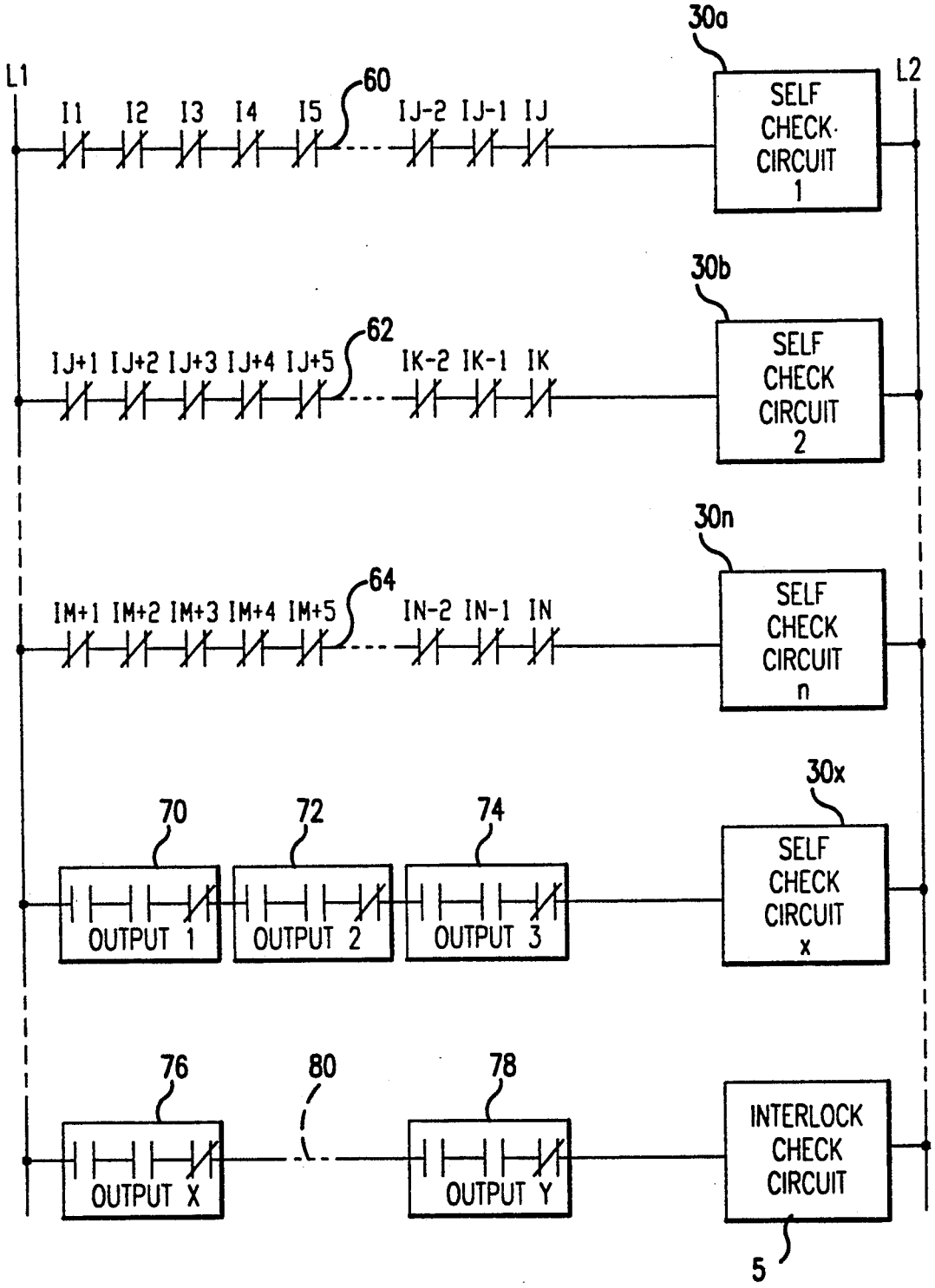
FIG. 4 is a block diagram for a system of interlocks using multiple self-checking modules to control a machine constructed according to the preferred embodiment.

FIG. 4 illustrates a means of combining multiple self-checking modular control circuits 30 into one interlock check circuit 5 constructed according to the preferred embodiment. This type of configuration would be used when there are a large number of interlocks involved in the control system. Each application is unique, and the number of interlocks connected in a group is variable. However, between 10 and 20 interlocks in a string is common. Accordingly, the interlocks are divided into groups 60, 62, . . . , 64, each group inputing to its own modular control circuit 30. Since the output circuit of each modular control circuit 30 consists of a set of three contacts, there is a limit due to ohmic losses as to the number of outputs that can be series connected as a final input into the interlock check circuit 5. Therefore it becomes necessary to interface separate self check circuits 30 to groups of output circuits. Thus, in FIG. 4, group interlocks 60 inputs into self check circuit 30*a*, group interlocks 62 inputs into self check circuit 30*b*, and so on. The series connection of output 70 of self check circuit 30*a*, output 72 of self check circuit 30*b*, and output 74 of self check circuit 30*c*, not shown, is connected to self check circuit 30*x*. The output 76 of self check circuit 30*x* is combined with other output contacts . . . , 78 until all strings have been reduced to one final string 80 as an input into the interlock check circuit 5. This tree structure ultimately would reduce any number of interlocks to one simple output string as an input to the interlock check circuit 5. None of the features of self checking or redundancy in each self check circuit 30 is lost by this procedure. FIG. 4 compares with FIG. 2 in that relay A coil 16 is replaced by self check circuit 30*a*, relay B coil 18 is replaced by self check circuit 30*b*, etc., and contact A 22 is replaced by output 70, contact B 24 is replaced by output 72, and so on.

Figure 5:
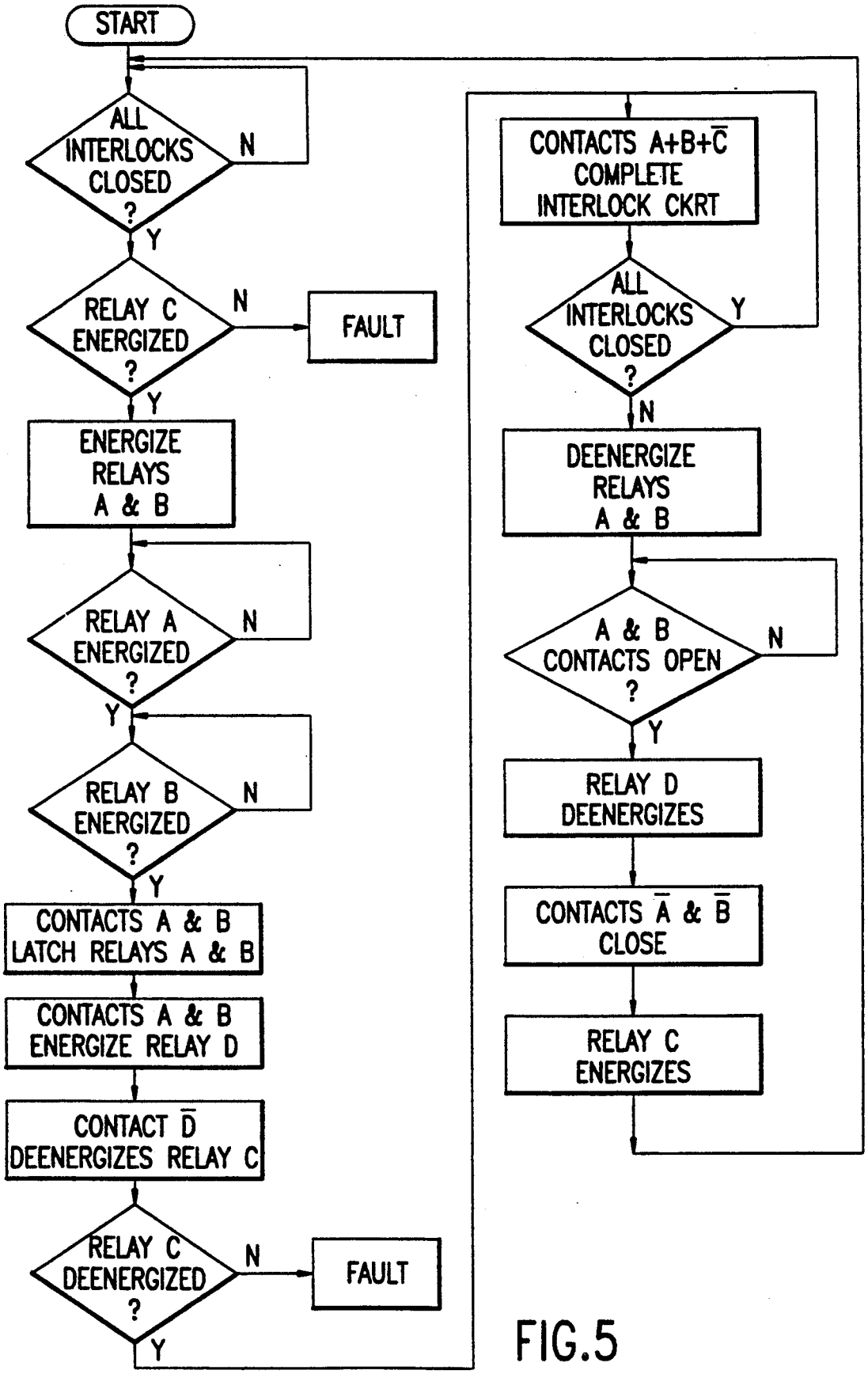
FIG. 5 is a flow diagram for operation of the self-checking modular control circuit constructed according to the preferred embodiment.

The flow diagram of FIG. 5 provides an overview of the operation of each individual self-checking modular control circuit constructed according to the preferred embodiment and is self explanatory.

While the specific embodiments have been illustrated and described, numerous modifications are possible without departing from the scope or spirit of the invention. The present examples and embodiments are to be considered in all respects as illustrative and not restrictive, and the invention is not to be limited to the details herein given.

I claim:

1. A control system for interconnecting series connected, normally-closed, multiple interlocks into a single interlock circuit, said control system comprising:

(a) an input for connecting said multiple interlocks;

(b) first means for determining if any of said multiple interlocks is open, said first means further including redundant components;

(c) second means for determining if all of said multiple interlocks are closed;

(d) an output, said output responsive to said first means and said second means;

(e) wherein said output is a closed circuit if all of said multiple interlocks are closed;

(f) wherein said output is an open circuit if any of said multiple interlocks is open: and (g) third means for returning said output to a closed circuit in a predetermined order if any of said multiple interlocks is opened and reclosed.

2. The control system of claim 1 wherein said third means further includes self checking means for determining if said first means and said second means are functional.

3. The control system of claim 2 wherein said output is responsive to said self checking means, said output is an open circuit if said first means is not functional.

4. The control system of claim 3 wherein said output is an open circuit if said second means is not functional.

5. The control system of claim 2 wherein said first means consists of a first relay and a second relay coupled in parallel wherein said output is an open circuit if either said first relay or said second relay malfunctions.

6. The control system of claim 2 wherein said second means consists of a third relay wherein said output is an open circuit if said third relay mulfunctions.

7. The control system of claim 6 wherein said output includes a contact from said first relay, a contact from said second relay, and a contact from said third relay, said contacts coupled together in a series connection.

8. A control system for interconnecting multiple normally-closed interlocks into a single interlock circuit, said multiple interlocks divided into a plurality of groups of series connected interlocks, said control system including a self checking control module for each of said plurality of groups of series connected interlocks, said self checking control module comprising:

(a) an input for connecting one of said plurality of groups of series connected interlocks;

(b) first means for determining if any of said series connected interlocks in said one of said plurality of groups of series connected interlocks is open, said first means further including redundant components;

(c) second means for determining if all of said series connected interlocks in said one of said plurality of groups of series connected interlocks are closed;

(d) an output, said output responsive to said first means and said second means;

(e) wherein said output is a closed circuit if all of said series connected interlocks in said one of said plurality of groups of series connected interlocks are closed;

(f) wherein said output is an open circuit if any of said series connected interlocks in said one of said plurality of groups of series connected interlocks is open; and (g) wherein said output is a closed circuit if any of said series connected interlocks in said one of said plurality of groups of series connected interlocks opens and recloses.

9. The control system of claim 8 wherein said output of each of said plurality of self checking control modules is coupled together in a series connection as an input to a separate, identical self checking control module having an output for coupling into said single interlock circuit.

10. The control system of claim 9 further including self checking means in each of said plurality of self checking control modules for determining if said first means and said second means are functional.

11. The control system of claim 10 wherein said output in each of said plurality of self checking control modules is responsive to said self checking means, said output is an open circuit if said first mean sis not functional.

12. The control system of claim 10 wherein said output in each of said plurality of self checking control modules is an open circuit if said second means is not functional.

* * * * *